United States Patent [19]

Cho

[11] Patent Number: 4,942,624

[45] Date of Patent: Jul. 24, 1990

[54] PROTECTIVE ARM GEAR

[75] Inventor: Soo S. Cho, Roseland, Fla.

[73] Assignee: Macho Products, Inc., Palm Bay, Fla.

[21] Appl. No.: 225,256

[22] Filed: Jul. 28, 1988

[51] Int. Cl.[5] ..... A41D 13/08

[52] U.S. Cl. ..... 2/16; 2/59; 2/24

[58] Field of Search ..... 2/24, 16, 59, 268

[56] References Cited

U.S. PATENT DOCUMENTS

| | | | |
|---|---|---|---|
| 3,446,880 | 3/1969 | Enicks | 2/16 X |
| 3,903,546 | 9/1975 | Rhee | 2/16 |
| 3,911,497 | 10/1975 | Lewis, Jr. et al. | 2/16 |
| 3,924,272 | 12/1975 | Allen et al. | 2/16 |
| 3,945,045 | 3/1976 | Rhee | 2/16 |
| 4,190,902 | 3/1980 | Rhee | 2/16 |

*Primary Examiner*—Werner H. Schroeder

*Assistant Examiner*—Jeanette Chapman

*Attorney, Agent, or Firm*—Duckworth, Allen, Dyer & Doppelt

[57] ABSTRACT

An improved protective device for the arm of a person receiving blows from a participant in martial arts activities or the like. The device includes a main body portion formed of a resilient, conformable material such as a closed cell polyvinyl chloride foam and a pliable coating of polyvinyl chloride or the like. The main body portion has an enlarged main section, an outwardly extending hand section and an inwardly extending elbow section. The hand and elbow sections are circumferentially displaced with respect to each other. Straps secure the main body portion to the arm of a wearer. Hand pieces secure opposite edges of the device at the hand portion for being gripped by the wearer and to assist in correct placement.

11 Claims, 2 Drawing Sheets

PROTECTIVE ARM GEAR

BACKGROUND OF THE INVENTION

1. Field of the Invention

The present invention relates to an arm gear for protecting a wearer from the force of a blow during karate practice, police training or other martial arts activity and, more particularly, to a device with a central section designed to protect a wearer from the force of blows to the forearm and with front and rear sections configured to protect a wearer from the force of blows to the hand and elbow.

2. Description of the Prior Art

While engaging in martial arts activities such as karate, whether practicing or participating in tactics training, an exhibition, demonstration or the like, a practitioner uses his hands, fists, arms, feet, or weapons to inflict blows upon another's head and body including the arm region. These blows may result in an injury to the receiver of the blow unless the force of the blow is lessened prior to physical contact. Such lessening may be achieved either by the receiver wearing protective gear or by the practitioner delivering less than full blows, i.e., pulling punches. During karate exhibitions, demonstrations, or the like, spectator appeal of the sport would be diminished if the delivery of the blows had to be restricted in order to avoid injury. Additionally, the benefits of practicing tactics such as may be required by police and military personnel and the value of simulation training or the like would be minimized if repeated blows could not be fully delivered by the practitioner to another, such as a colleague, coach or the like. As can be readily understood, protective gear is the preferred solution. Such gear should not only protect the wearer from injury, it should also allow the person practicing the martial arts or tactics training to repeatedly deliver full blows and thus improve his skills. In the case of police baton training, for example, the gear should permit blows to be deliveed with nightsticks with force which approximates that needed for real life use by officers in the streets.

In an attempt to provide effective protection for the wearer, particularly for the arm region, a number of proposed protective devices have been designed and are available commercially. To achieve the primary objective of safety, any such device must afford superior protection to the wearer. Because of the strenuousness of the activity by the wearer while using any such protective device, it must be lightweight and cover only areas requiring protection so as to minimize any weight burden. It must also permit freedom of movement so that the user may effectively participate in the activity as intended.

Typical devices designed in an effort to achieve these objectives are described in the patent literature exemplified by Reinfandt U.S. Pat. No. 3,902,196; Allen et al U.S. Pat. No. 3,924,272 Rhee U.S. Pat. Nos. 4,190,902, and 4,300,543 . Each of those prior devices provides some protection to the wearer but at the same time causes some unnecessary inconvenience. Some of these prior devices combine protective foam with heavy, rigid material thus causing an added weight burden to the user without an equivalent benefit. Others cover insufficient portions of the wearer's arm so that inadequate protection is provided. Others cover more of the wearer's arm than necessary which increases cost and body heating. Yet others unnecessarily limit the wearer's freedom of movement.

As illustrated by the large number of prior devices, continuing efforts are being made in an attempt to solve the problem of designing protective, lightweight, unencumbering, economical arm gear. None of the known devices, however, discloses or suggests the present inventive device as disclosed herein. The present invention achieves its purposes, objectives and advantages over the prior approaches through a new, useful and unobvious device, at a reasonable cost, and through the utilization of only readily available materials.

SUMMARY OF THE INVENTION

The present invention comprises an apparatus for protecting the arm of a person participating in martial arts activities or the like. In an illustrative embodiment, the apparatus has a main body portion formed of a resilient, conformable foam material having a pliable coating. The main body portion has an enlarged main section, an outwardly extending hand section and an inwardly extending elbow section. The inwardly extending elbow section and the outwardly extending hand section are circumferentially displaced. Straps secure the main body portion to the arm of a wearer. The straps include a pair of straps circumferentially coupled to the edges of the main section to secure the main body portion around the arm of the wearer. The apparatus preferably includes hand pieces grippable by a user and attached to opposite edges of the hand section to assist in proper positioning. The foam material may be a closed cell polyvinyl chloride foam material with a coating of polyvinyl chloride. The material is preferably provided with apertures at spaced locations in the main body for ventilation and to aid in shock dispersion.

When worn, the main section covers and extends around the wearer's forearm, having an end distal from the hand section forming the elbow section. The elbow section curves around and covers the underside of the elbow. The hand section includes reduced area of coverage adjacent the wearer's wrist to permit ready flexing of the apparatus at the wrist when the wearer forms a fist.

BRIEF DESCRIPTION OF THE DRAWINGS

For a more complete understanding of the nature, objects and advantages of the present invention, reference should be had to the following detailed description, taken in conjunction with the accompanying drawing in which.

DETAILED DESCRIPTION OF THE INVENTION

The protective arm gear 10 shown in the FIGS. illustrates the preferred embodiment of the present invention. The principal component of the gear or device is a main body portion 12. The main body portion is fabricated of a suitable material 14, conformable and resilient as well as capable of absorbing energy when contacted and deformed by a blow. Preferred materials include elastomers, such as a closed cell polyvinyl chloride foam or the like. The material is preferably provided with a suitable, pliable surface coating or casing 16 which entirely covers the surface of the foam material. If the material is a polyethylene or polyurethane foam, the coating may not be applied. The coating may be applied to the foam by painting, dipping, or other method of application. A tough, rugged, pliable plastic such as polyvinyl chloride has been found to be a preferred material for the coating. The portions constituting the arm gear are preferably cut to shape while in a flat form. After cutting, the pieces may be shaped to the desired form while the coating is applied and dried. Supplemental straps, indicia or the like may finally be applied. The foam material is typically one-half to three-quarter inch in thickness.

Figure 1:
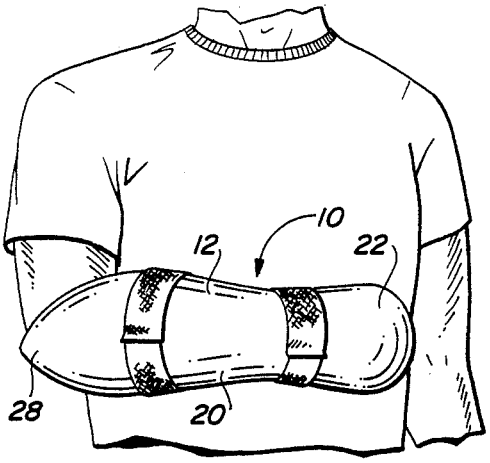
FIG. 1 is a perspective view of an arm gear incorporating the principles of the present invention and illustrating such gear on the arm of a wearer in position for receiving a blow.
Figure 2:
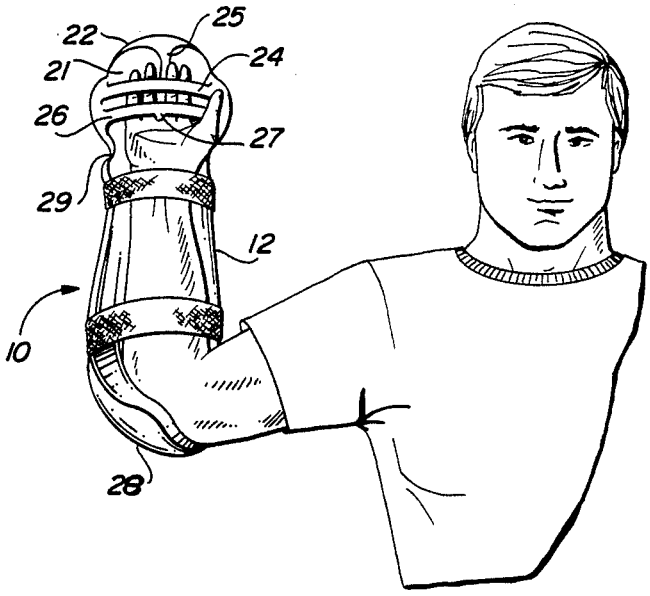
FIG. 2 is a perspective view of the arm gear shown in FIG. 1 but illustrating the gear from the opposite side.
Figure 3:
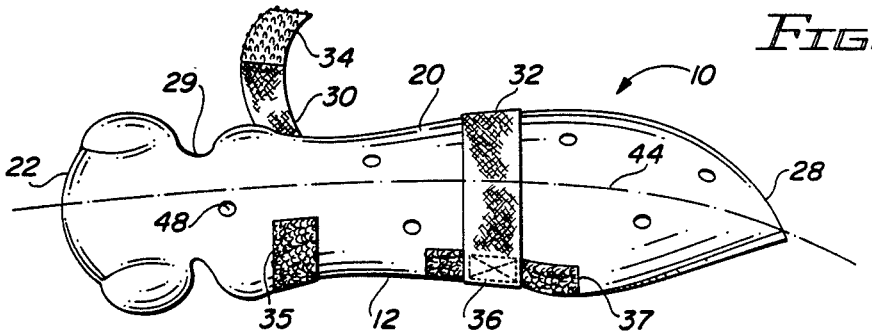
FIGS. 3 and 4 are perspective views of the arm gear shown in FIGS. 1 and 2 as seen from the front and reverse sides, respectively.

The foam member or main body portion 12 of the arm gear or protector 10 includes a generally rectangular central section 20 of coated foam adapted to partially encompass, and essentially conform to, the outside of the wearer's arm as can be seen in FIGS. 1 and 2. When worn and with the holding his forearm horizontally in front of him with his knuckles vertical and facing outwardly, the arm protector 10 is in the ready position as shown in FIG. 1 for receiving blows from the participant delivering the blows. The protective foam does not extend to the inside of the wearer's arm as can be seen in FIG. 2 since blows are not normally received there. Protective foam in this inside arm area would merely burden a wearer with unnecessary weight and encumber his movements as when providing a moving target or a fixed target at a varying location. Note is taken that a similar protective device could be provided to that shown for the wearer's left arm, the similar device being only a mirror image of the illustrated arm gear.

Figure 4:
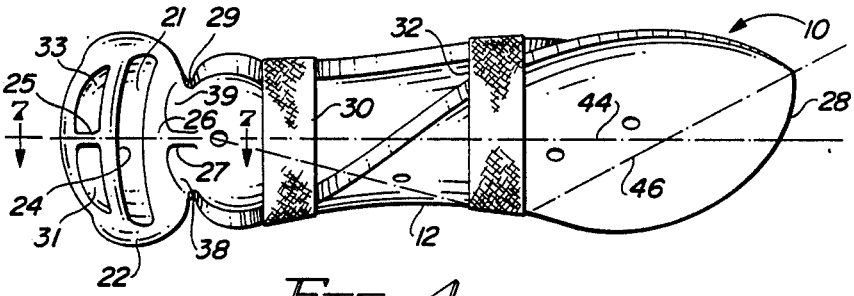

The outer portion of the central or main section 20 of the foam main body portion 12 is provided with an outwardly extending section 22 to protect the hand and knuckles of a wearer. This hand section 22 is fabricated of a coated foam, an extension of the main section. The section is somewhat spherical and concave to receive the knuckles and back of the hand of the wearer and includes a reduced area of coverage 29 adjacent to the wearer's wrist to permit ready flexing of the apparatus when the wearer makes a fist. A hand piece in the form of an elongated strap or web 24 extends laterally across the in surface 21 of this section from edge to edge to help the hand section retain its appropriate shape as shown in FIGS. 1 and 4. An additional cross-piece in the form of an elongated strap or web 25 may be added as shown in FIG. 4 and extends longitudinally across the inside 21 of the section 22 from the center of the outer edge of the hand piece 24 to the outer end of the hand section 22. These pieces 24 and 25 are glued at their ends into position as illustrated thereby coupling the opposite side edges and front of the gear prior to forming and spraying.

A second separate hand in the form of an elongated strap or web peice 26 extends laterally piece from edge to edge across the inside 21 of the hand section 22, spaced inwardly toward the main section 20 from the hand piece 24. Another elongated strip or web cross-piece 27 extends longitudinally of the section 22 from the center of the inner edge of the hand piece 26 to connect to the inside 21 of the hand section 22 adjacent the reduced area 29 at a point slightly outwardly of the junction of the inner end of section 22 with the main body portion 12. The pieces 26 and 27 are glued into their illustrated positions in the same manner as pieces 24 and 25.

The positions of the hand pieces 24 and 26 allow the wearer of the device to grasp them and thereby give additional support to the device particularly when the device is receiving blows from the person practicing the martial arts. The positioning of the pieces 24 and 26 also allows for grabbing and "cuffing" techniques, especially useful in police training. The spacing of the pieces 24 and 26 assists in bringing the hand section 22 into its proper protected placement and maintaining it there. The hand pieces 24, 25, 26 and 27 are dimensioned, configured and positioned to permit the wearer's fingers to be inserted beneath the hand pieces 24 and 26 and through openings 31, 33, 38 and 39 left between the pieces 24, 25, 26 and 27 and the section 22, with the cross-pieces 25 and 27 brought between the middle and ring fingers as shown in FIG. 2, the inner piece 27 acting as a limit to the outward movement of the fingers into the space between the straps 24, 26 and the inside 21 of the device 10. When the fingertips of the wearer are curled around the outer edge of the hand piece 24, the cross-piece 27 holds the inner end of section 22 at the base of the fingers, while cross-piece 25 is drawn inwardly with the piece 24 by the curling of the fingers and acts to contour the outer end of section 22 around the hand.

Figure 5:
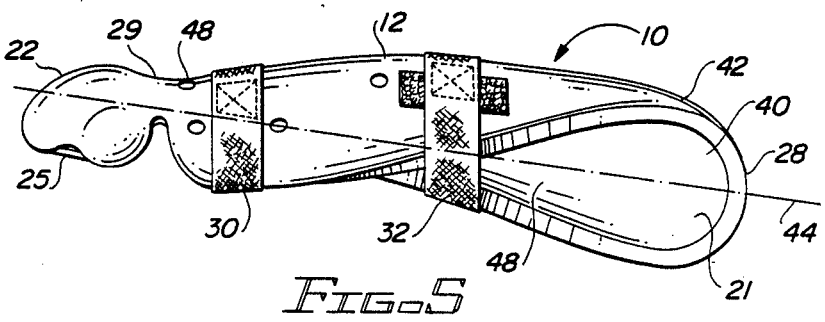
FIGS. 5 and 6 are perspective views of the arm gear of FIGS. 3 and 4 rotated 90 degrees from those views.
Figure 6:
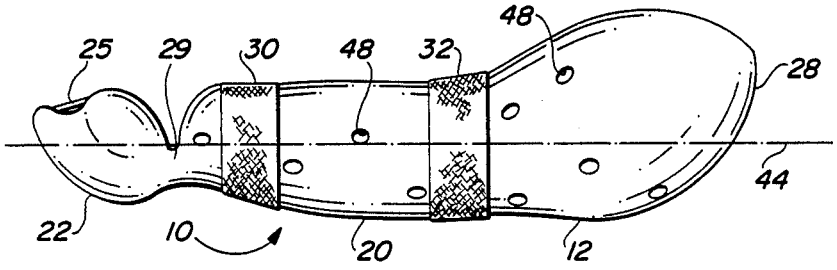
Figure 7:
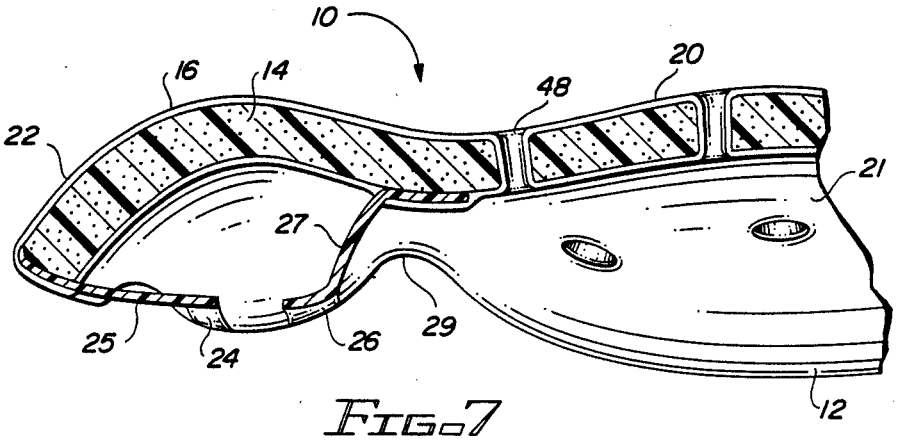
FIG. 7 is an enlarged, fragmentary sectional view of the arm gear taken along the line 7—7 in FIG. 4.
Figure 8:
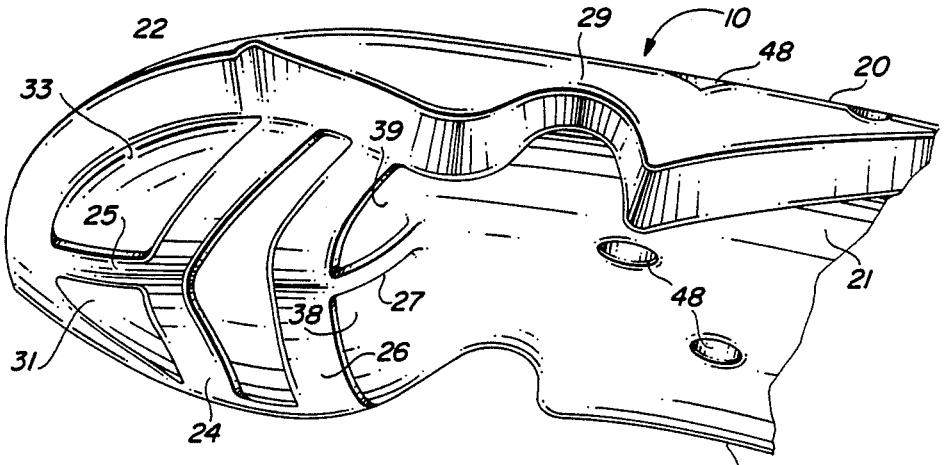
FIG. 8 is an enlarged perspective view of the underside of the hand section of the gear of FIGS. 1–7.

Inwardly extending from the central or main section of the foam member is a section 28 for protecting a wearer's elbow. Like the hand section, the elbow section is somewhat spherical and concave to fully receive and protect the elbow of the wearer. As can be seen in the drawings, particularly FIGS. 1 and 5, the elbow section is circumferentially rotated with respect to the arm of the wearer and the hand portion so that adequate protection is provided to the elbow and forearm of the wearer when receiving upwardly directed blows. This is the normal direction of blows from a person who is practicing karate or the other martial arts or who is participating in tactics training. Like the central section and hand section, the inward elbow section 28 is fabricated of a coated foam, an extension of the main section.

A plurality of elastic straps 30 and 32, preferably two, are provided to circumferentially encompass the central or main section of the arm protector or gear 10. One end of the strap 30 is fixedly attached to the exterior surface 42 of the arm gear adjacent the hand section. The free end of the strap 30 includes one element of a hook and eye type fastener 34 releasably couplable to a mating element 35 of such a fastener attached to the gear. The ends of strap 32 are similarly coupled with a hook and eye type fastener element 36 attached thereto for releasably coupling with a complementary fastener element 37 attached to the gear. The hook and eye type fasteners are commercially available under the tradename Velcro. The straps, in association with the hand piece and the shape of the device, assist in retaining the device on the arm of a wearer during operation and use.

The protective device or arm gear 10 is thus formed of a foam member or main body portion 12 and associated straps 30 and 32. The foam member or main body portion includes the central or main section 20, the outer or hand section 22 and the inner or elbow section 28. It also has an interior surface 40 and an exterior surface 42. It is formed with a slight curve about an axis 44, the axis being common with the axis of the wearer's arm, to thereby conform to the arm of a wearer. The gear extends a sufficient length to fully cover the elbow and hand and, therebetween, the forearm of the wearer. Ventilation may be provided by a plurality of holes or apertures 48 extending through the gear 10 at spaced locations. The spacing of the holes 48 is chosen so that they also aid in the dispersion of shock from blows by dissipating energy through the outward venting of confined air.

The foam main body portion 12 includes a center line 46 with essentially equal volumes of foam on either side thereof in the central section 20. The center line 46 extends through the hand section 22, the main central section 20 and the elbow section 28. The center line is spiraled with respect to the axis 44 of the wearer's arm, the axis of the wearer's arm being coincident with the axis of the device when worn by a person receiving blows. The center line 46, spiraling with respect to the axis 44, is another way of saying that the elbow section and hand section are circumferentially rotated or displaced with respect to each other. Without such orientation of sections of the device, the device could not properly protect the desired areas of the wearer's arm from upwardly directed punches and kicks without the addition of unnecessary foam material to the device. As can be seen by comparing the various FIGS., when properly orientated and utilized, the device protects the back of the wearer's hand including his knuckles at one end as well as the downwardly facing inside of the wearer's forearm and elbow. This configuration of axis and center line allows for comfortable movement by a wearer with maximum protection afforded due to the protective material being only on those parts of the body requiring protection.

While the present invention has been described with respect to a particular preferred embodiment, many modifications and variations will become apparent to those skilled in the art. Accordingly, all such variations and modifications are intended to be included within the scope of the appended claims.

What is claimed is:

1. For use by a person receiving blows from a participant in martial arts activities or the like, an improved protective device for the arm of the wearer comprising:

a main elongated body portion formed of a resilient, conformable foam material, the main body portion having an enlarged main section adapted to partially encompass and comform to the outside of a wearer's forearm, and a hand section extending outwardly from the main section and being adapted to cover the hand and knuckles of a wearer, and the main body portion having an interior surface and an exterior surface; and strap means to secure the main body portion to the arm of a wearer;

the device further comprising a first elongated hand piece extending laterally across the interior surface of the main body portion and securing opposite edges of the hand section; a first elongated cross-piece extending longitudinally across the interior surface from a central part of the first hand piece to an outer end of the hand section; a second elongated hand piece extending laterally across the interior surface of the main body portion, said second hand piece being spaced inwardly toward said main section from said first hand piece and also securing opposite edges of the hand section; and a second elongated cross-piece extending from a central part of the second hand piece to connect the interior surface at a point adjacent the junction of the hand section and the main section;

the first and second hand pieces and the first and second cross-pieces being dimensioned, configured and adapted so that the fingers of the wearer can be inserted between the hand pieces and the interior surface with the cross-pieces being located between adjacent fingers of the wearer, so that when the fingertips of the wearer are curled around the first hand piece, the second cross-piece acts as a limit to hold the second hand piece in fixed position relative to the wearer's hand at the base of the fingers and the first cross-piece acts to draw the outer end of the hand section inwardly toward the main section with the first hand piece, to cause the hand section to conform to the wearer's closed hand when the fingertips are curled into a fist.

2. The device as set forth in claim 1, wherein said strap means includes a pair of straps circumferentially coupling edges of the main section to secure the main body portion around the arm of the wearer.

3. The device as set forth in claim 1, wherein the foam material comprises a closed cell polyvinyl chloride foam.

4. The device as set forth in claim 3, further comprising a coating polyvinyl chloride covering the foam material.

5. The device as set forth in claim 1, wherein the main body portion further comprises an elbow section extending inwardly from the main section opposite the hand section, and the elbow section is further defined by a center line having approximately equal volumes of material on either side thereof, the center line tracing a spiral path with respect to an axis corresponding to a wearer's arm such that the elbow section is circumferentially rotated with respect to the hand section.

6. Improved protective gear for the hand, forearm and elbow of a wearer when receiving blows during martial arts activities or the like, comprising:

a resilient member having an interior surface and an exterior surface, the resilient member further having an enlarged generally rectangular central section, an outwardly resilient member further extending hand section and an inwardly extending elbow section, the member having an axis which is coextensive with the axis of the forearm of the wearer and a center line extending through the central section with generally equal volumes of resilient material on either side thereof, the center line being spiraled with respect to the axis;

the gear further comprising a first elongated hand piece extending laterally across the interior surface of the resilient member and securing opposite edges of the resilient member at the hand section; a first elongated cross-piece extending longitudinally across the interior surface from a central part of the first hand piece to an outer end of the hand section;

a second elongated hand piece spaced inwardly toward the central section from the first hand piece and also securing opposite edges of the hand section; and a second elongated cross-piece extending from a central part of the second hand piece to connect the interior surface at a point of the hand section adjacent the central section; the first and second hand pieces and the first and second cross-pieces being dimensioned, configured and adapted so that the fingers of the wearer can be inserted between the hand pieces and the interior surface with the cross-pieces being located to fit between adjacent fingers of the wearer, so that when the fingertips of the wearer are curled around the first hand piece, the second cross-piece acts as a limit to hold the second hand piece in fixed position relative to the wearer's hand at the base of the fingers.

7. The device as in claim 1, wherein said hand section further includes a wrist section of reduced area of coverage adjacent the wearer's wrist, the wrist section being dimensioned, configured and adapted to permit ready flexing of the device at the wrist when the wearer forms a fist; and wherein said second cross-piece extends to connect the interior surfaces at a point adjacent the wrist section.

8. The device as in claim 6, wherein said hand section further includes a wrist section of reduced area of coverage adjacent the wearer's wrist, the wrist section being dimensioned, configured and adapted to permit ready flexing of the device at the wrist when the wearer forms a fist; and wherein said second cross-piece extends to connect the interior surface at a point adjacent the wrist section.

9. The gear as set forth in claim 8, further including strap means coupling opposite edges of the central section to secure the gear to the arm of the wearer.

10. The gear as set forth in claim 9, therein the resilient material is a closed cell polyvinyl chloride foam.

11. The gear as set forth in claim 10, further including a coating of polyvinyl chloride covering the resilient material.

* * * * *